United States Patent [19]

Hennig

[11] 4,180,193

[45] Dec. 25, 1979

[54] APPARATUS FOR REMOVING THE FORWARD MARGIN OF A SHEET

[75] Inventor: Franz Hennig, Dusseldorf, Fed. Rep. of Germany

[73] Assignee: Jagenberg-Werke Aktiengesellschaft, Dusseldorf, Fed. Rep. of Germany

[21] Appl. No.: 880,661

[22] Filed: Feb. 23, 1978

[30] Foreign Application Priority Data

Feb. 26, 1977 [DE] Fed. Rep. of Germany ..... 2708510

[51] Int. Cl.[2] ..... B26F 3/02

[52] U.S. Cl. ..... 225/101; 225/105

[58] Field of Search ..... 225/101, 103, 105

[56] References Cited

U.S. PATENT DOCUMENTS

| | | | |
|---|---|---|---|
| 2,331,351 | 10/1943 | Seeley | 225/105 |
| 2,579,835 | 12/1951 | Lather | 225/101 |
| 3,244,336 | 4/1966 | Chauvin | 225/105 X |
| 3,895,751 | 7/1975 | Shepherd | 225/101 X |

*Primary Examiner*—Frank T. Yost

*Attorney, Agent, or Firm*—Sprung, Felfe, Horn, Lynch & Kramer

[57] ABSTRACT

In an apparatus for separating the forward margin of a sheet which is joined along a parting line and is held at the forward margin by grippers of a transport means and having upper and lower separating tools disposed above and below the parting line and movable with respect to one another, the improvement comprising an anvil disposed at the underside of the sheet to be separated and which is mounted for movement with respect to the lower separating tool and for co-action with the upper separating tool to form a pair of gripper jaws for the sheet which is movable with the gripped sheet with respect to the lower separating tool during the separating action.

11 Claims, 2 Drawing Figures

APPARATUS FOR REMOVING THE FORWARD MARGIN OF A SHEET

BACKGROUND

The invention relates to an apparatus for the removal of the leading margin of a sheet which is joined thereto only by webs along a parting line, consisting of upper and lower separating tools disposed one on either side of the parting line and movable against one another.

Such an apparatus is connected, for example, to the output of a punch in which the sheet is divided by punching into individual parts which are joined together only loosely by thin webs. This sheet is conveyed by a transport means from the punch to a stacking point, its leading edge being held by grippers of the transport means. Before it is laid down, its leading margin is removed. In a known apparatus of the above-mentioned kind, this removal is performed by upper and lower separating tools in that the upper separating tool acts downwardly on the sheet on the sheet side of the parting line, while the lower separating tool acts from below on the leading margin side. It has been found that the sheet is severely vibrated in this type of separation. If the sheet consists of individual areas joined together only by webs, this vibration can be severe enough to break the webs and thus disrupt the assembly of the individual areas, so that trouble-free stacking is no longer possible (German Pat. No. 1,068,988).

THE INVENTION

The invention is addressed to the problem of creating an apparatus for the removal of the forward margin of a sheet so as not to produce any shaking in the separating action.

This problem is solved if the separating tool disposed on the upper side of the sheet forms with an anvil disposed on the bottom side of the sheet a pair of jaws for gripping the sheet, which is movable with the gripped sheet in relation to the other separating tool in the separating action.

Since the sheet is held during the separating action by the pair of gripping jaws, vibrations are kept away from the sheet, so that the danger no longer exists that the breaking of the webs will destroy the union of the individual areas composing the sheet.

The common movement of the upper separating tool and of the anvil can be achieved simply by mounting the anvil for yielding resiliently. The resilient mounting of the anvil consists preferably of a clamped spring loop.

In a further development of the invention, the anvil and the lower separating tool are commonly disposed on a beam by which they are movable out of the path of movement of the grippers. The beam can be carried by a double crank.

A movement aiding the separating action is imparted to the upper separating tool by the fact that it is borne by a guiding means formed by a pair of cranks which impart to the separating tool, in addition to the movement perpendicular to the plane of the sheet, a movement in the plane of the sheet away from the lower separating tool (tearing action).

Especially in the case of sheets whose parting line is not rectilinear but staggered, an apparatus is suitable in which the lower and upper separating tools and the anvil form groups which are disposed side by side in the manner of a rake and are adjustable in the plane of the sheet for staggering in the parting line. With an apparatus constructed in this manner it is possible to separate the leading margin from the sheet in a distortion-free manner.

BRIEF DESCRIPTION OF THE DRAWINGS

The invention is further explained with the aid of a drawing representing an embodiment thereof, wherein.

DETAILED DESCRIPTION OF THE INVENTION

Figure 3:
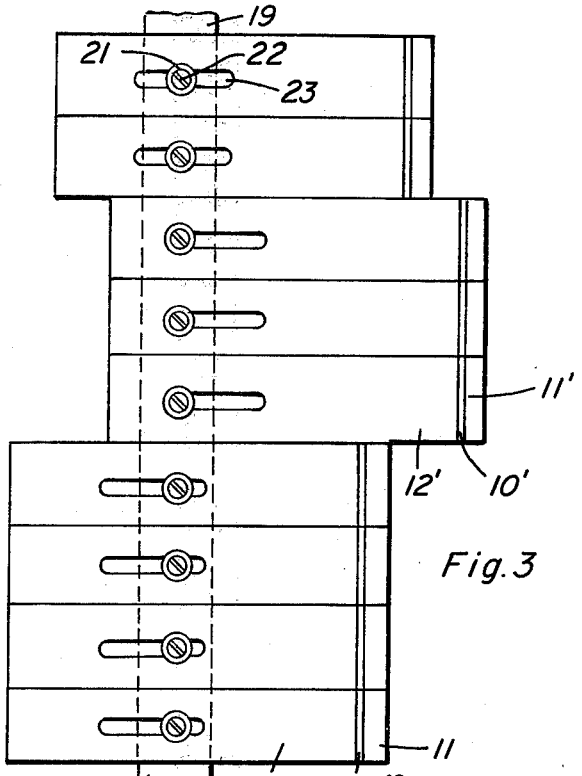
FIG. 3 is a top view of a detail of the apparatus.

A sheet 1 is gripped at its leading margin 3 by the grippers 2 and transported from a punch, which is now shown, to a stacking point 4. The transport means is a circulating chain which is indicated in the drawing by the broken line 5, which circulates in the direction of the arrow 6, and to which the grippers 2 are fastened.

Figure 2:
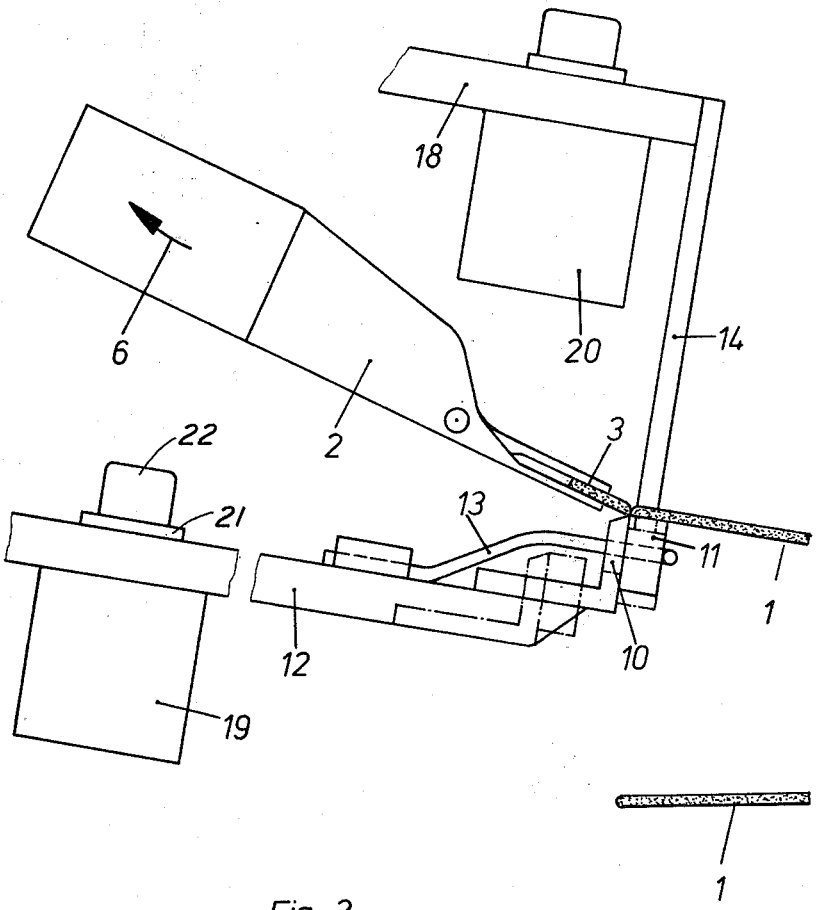
FIG. 2 is an enlarged partial side view of the apparatus.

Underneath the chain 5 there is a beam 9 for a lower separating tool 10, 10' and an anvil 11, 11'. As shown in FIG. 2, the separating tool 10, 10' is fastened to an arm 12, 12' to which the anvil 11, 11' is also fastened by a spring loop 13. As long as no separating is being performed, the lower separating tool 10, 10' and the anvil 11, 11' are in the position represented by the dash-dotted lines, into which they are brought by the double crank 7, 8, with the beam 9.

Above the path of movement of the sheet 1, an upper separating tool 14, 14' is pivotingly mounted by means of a beam 15 to a double crank 16, 17. From the position represented in solid lines, the upper tool 14, 14' can be brought into the position represented by the dash-dotted lines, outside of the path of movement of the grippers 2. The upper separating tool 14 is held on an arm 18, 18'.

Figure 1:
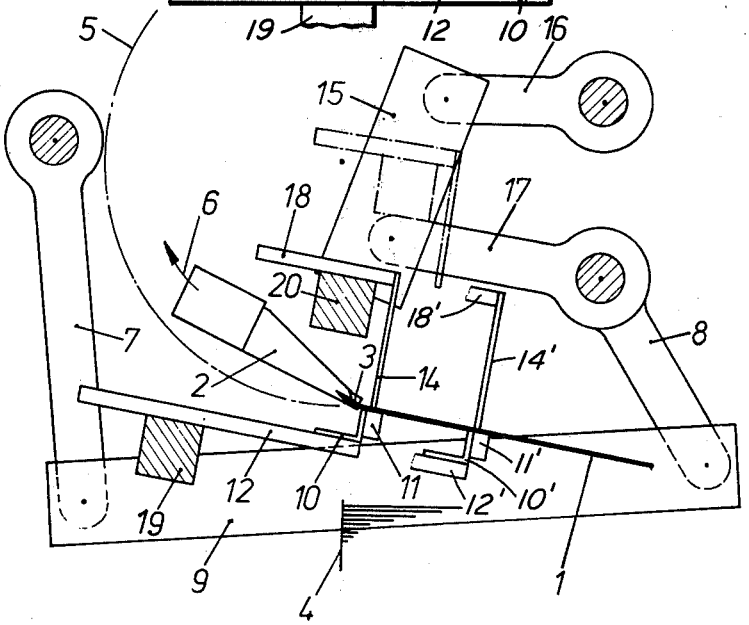
FIG. 1 is a diagrammatic side elevational view of the apparatus.

As shown in FIGS. 1 and 3, the lower separating tool 10, 10' with the anvil 11, 11' and the upper separating tool 14, 14' with their arms 12, 12', 18, 18' are parallelly displaceable and fixable on bars 19 and 20. This movability makes it possible to adjust the separating tools to different sheet formats. The lower and upper separating tools 10, 10', 14, 14', and the anvil 11 form a plurality of adjacently disposed groups, each being adjustable independently of the other by means of screws 21, washers 22 and elongated slots 23. This permits adaptation even to leading margins in which the parting line is not rectilinear but staggered. The staggered adjustment assures that the leading edge will be gripped at the parting line on each section in an optimum manner for the separating action, so that no distortions can occur in the separating action. As an example in FIG. 3, the group of arms 12 are shifted to the left, while the group of arms 12' are shifted to the right.

The apparatus operates in the following manner:

While the lower and upper separating tools 10 and 14 are in the position represented by dash-dotted lines in FIGS. 1 and 2, the path of movement is free for the grippers 2 held on the chain 5, and the sheet 1 can be brought into the position represented in FIGS. 1 and 2. In this position, first the lower double crank 7, 8, are swung thereby bringing the lower separating tool 10 with the anvil 11 into the working position represented in solid lines in engagement with the sheet 1. In this position the sheet 1 is held by its leading edge 3 by the grippers 2. Now the double crank 16, 17, is swung counterclockwise, the upper separating tool 14 coming into engagement with the upper side of the sheet and gripping the sheet between itself and the anvil 11 which is located beneath it and is resiliently supported. As the downward movement continues, the separation of the sheet from the sheet margin takes place, because the bottom separating tool 10 remains in its position. The movement of the upper separating tool 14 is performed, on account of the guidance provided by the double crank 16, 17, such that the sheet 1 is not only moved downwardly but also slightly away from the separating tool 10. The separating action is assisted by the tearing action that is thus produced. During the entire separating action, the sheet 1 remains gripped between the upper separating tool 14 and the anvil 11, so that vibration originating in the separating action cannot be transmitted to the sheet 1. The stresses produced in the separating action are received exclusively by the separating tool 14 and the anvil 11.

Not until the separation is completed is the double crank 16, 17, swung back again, thereby terminating the gripping action of the upper separating tool and the anvil 11. At the same time, the lower double crank 7, 8, is swung clockwise. The sheet 1 can thus fall undisturbed onto the stack 4. When the double cranks 7–8 and 16–7 with the parts which they carry are swung into the positions represented by dash-dotted lines, space is created to accommodate the movement of the grippers 2 carrying a new sheet.

It will be appreciated that the instant specification and examples are set forth by way of illustration and not limitation, and that various modifications and changes may be made without departing from the spirit and scope of the present invention.

What is claimed is:

1. In an apparatus for separating the forward margin of a sheet which is joined to the forward margin along a parting line only by webs and is held at the forward margin by grippers of a transport and having upper and lower separating tools disposed above and below the parting line and movable with respect to one another, wherein the improvement comprises: an anvil disposed at the underside of the sheet to be separated and means mounting the anvil for movement with respect to the lower separating tool and for co-action with the upper separating tool to form a pair of gripper jaws for the sheet which is movable with the gripped sheet with respect to the lower separating tool during the separating action comprising means mounting the anvil and the lower separating tool commonly on a beam and a double crank for carrying the beam to move the anvil and the lower separating tool into and out of the path of movement of the grippers.

2. The apparatus according to claim 1, wherein the means mounting the anvil mounts same for resilient yielding.

3. The apparatus according to claim 2, wherein the resilient mounting of the anvil comprises a clamped spring loop.

4. The apparatus according to claim 1 further comprising guiding means for the upper separating tool comprising a second beam on which the upper separating tool is mounted and a double crank carrying the second beam and which imparts to the upper separating tool in addition to the movement perpendicular to the sheet plane, a movement in the sheet plane away from the lower separating tool.

5. The apparatus according to claim 1, wherein the upper and lower separating tools and the anvil form a plurality of groups which are disposed side by side in a rake-like manner and are adjustable in the sheet plane for a staggering in the parting line.

6. In an apparatus for separating the forward margin of a sheet which is joined to the forward margin along a parting line only by webs and is held at the forward margin by grippers of a transport and having upper and lower separating tools disposed above and below the parting line and movable with respect to one another, wherein the improvement comprises: an anvil disposed at the underside of the sheet to be separated and means mounting the anvil for movement with respect to the lower separating tool and for co-action with the upper separating tool to form a pair of gripper jaws for the sheet which is movable with the gripped sheet with respect to the lower separating during the separating action wherein the upper and lower separating tools and the anvil form a plurality of groups which are disposed side by side in a rake-like manner and are adjustable in the sheet plane for a staggering in the parting line.

7. The apparatus according to claim 6, wherein the means mounting the anvil mounts same for resilient yielding.

8. The apparatus according to claim 7, wherein the resilient mounting of the anvil comprises a clamped spring loop.

9. The apparatus according to claim 6, wherein the means mounting the anvil includes means mounting same and the lower separating tool commonly on a beam with which they are movable out of the path of movement of the grippers.

10. The apparatus according to claim 9, wherein the mounting means for the anvil comprises a double crank carrying the beam.

11. The apparatus according to claim 6 further comprising guiding means for the upper separating tool comprising a double crank which imparts to the upper separating tool in addition to the movement perpendicular to the sheet plane, a movement in the sheet plane away from the lower separating tool.

* * * * *